United States Patent [19]

Naito et al.

[11] 4,455,363

[45] Jun. 19, 1984

[54] HEAT-DEVELOPABLE COLOR PHOTOGRAPHIC MATERIAL WITH POLYMERIC COLOR COUPLER

[75] Inventors: Hideki Naito; Hiroshi Hara; Morio Yagihara, all of Minami-ashigara, Japan

[73] Assignee: Fuji Photo Film Co., Ltd., Kanagawa, Japan

[21] Appl. No.: 471,375

[22] Filed: Mar. 2, 1983

[30] Foreign Application Priority Data

Mar. 2, 1982 [JP] Japan ..... 57-32547

[51] Int. Cl.[3] ..... G03C 1/40; G03C 5/54; G03C 7/32

[52] U.S. Cl. ..... 430/203; 430/226; 430/548

[58] Field of Search ..... 430/203, 226, 548, 555

[56] References Cited

U.S. PATENT DOCUMENTS

| | | | |
|---|---|---|---|
| 3,531,286 | 9/1970 | Renfrew | 430/351 |
| 3,761,270 | 9/1973 | de Mauriac et al. | 430/351 |
| 4,021,240 | 5/1977 | Cerquone et al. | 430/203 |
| 4,264,723 | 4/1981 | Ichijima et al. | 430/555 |
| 4,351,897 | 9/1982 | Aoki et al. | 430/555 |
| 4,366,237 | 12/1982 | Ichijima et al. | 430/555 |
| 4,407,936 | 10/1983 | Ichijima et al. | 430/555 |

OTHER PUBLICATIONS

"Positive Images . . . Materials", Kohrt, *Research Disclosure,* No. 16408, pp. 15 & 16, 12/1977.

*Primary Examiner*—Richard L. Schilling
*Attorney, Agent, or Firm*—Sughrue, Mion, Zinn, Macpeak & Seas

[57] ABSTRACT

A heat-developable color photographic material comprising a support having thereon at least a light-sensitive silver halide, an organic silver salt oxidizing agent, a hydrophilic binder, a reducing agent for the silver halide and/or the organic silver salt oxidizing agent and a magenta color image forming polymer coupler latex which is capable of forming a diffusible dye upon coupling with an oxidized product of the reducing agent and which is a homopolymer or copolymer having a repeating unit derived from a monomer coupler represented by the following general formula (I):

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubtituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

The heat-developable color photographic material can easily provide a clear color image by imagewise exposure to light and heat development procedure.

47 Claims, No Drawings

HEAT-DEVELOPABLE COLOR PHOTOGRAPHIC MATERIAL WITH POLYMERIC COLOR COUPLER

FIELD OF THE INVENTION

The present invention relates to a process of forming a color image by heat development. Particularly, the present invention relates to a novel process for obtaining a color image having a high magenta color density by diffusion transfer of a dye formed upon heat development into a support which has a mordant layer.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for photographic materials using silver halide, many techniques capable of easily and rapidly obtaining images have been developed by changing the conventional wet process using a developing solution into a dry process such as a process using heat, etc.

Heat-developable photographic materials are known in the field of these techniques, and heat-developable photographic materials and processes therefor have been described in U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1878).

Many different processes for obtaining color images have been proposed.

A process for forming a positive color image by a silver dye bleach process utilizing heat development, with useful dyes and methods for bleaching has been described, for example, in *Research Disclosure,* No. 14433, pages 30 to 32 (April, 1976), ibid., No. 15227, pages 14 and 15 (Dec., 1976) and U.S. Pat. No. 4,235,957, etc.

However, this process requires an additional step and an additional material for accelerating bleaching of dyes, for example, heating with a superposed sheet with an activating agent. Furthermore, it has a drawback that the resulting color images are gradually reduced and bleached by coexisting free silver during preservation for a long period of time.

Also, a process for forming a color image utilizing a leuco dye has been described, for example, in U.S. Pat. Nos. 3,985,565 and 4,022,617, etc. However, this process is not desirable because it is difficult to stably incorporate the leuco dye in the photographic material and coloration gradually occurs during preservation.

Another process which comprises introducing a nitrogen containing heterocyclic group into a dye, forming a silver salt and releasing a dye by heat development has been described in *Research Disclosure,* No. 16966, pages 54 to 58 (May, 1978). According to this process, clear images cannot be obtained, because it is difficult to control the release of dyes from nonexposed areas, and thus it is not a conventionally applicable process.

With respect to process for forming color images by the reaction of an oxidized product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (Sept., 1975) and the combination of a sulfonamidophenol type reducing agent and a 4-equivalent coupler as described in U.S. Pat. No. 4,021,240. These processes, however, are disadvantageous in that turbid color images are formed, because a reduced silver image and a color image are simultaneously formed on the exposed area after heat development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Further, the couplers utilized in the abovedescribed processes are same as those which are employed in color photographic materials for the wet process using a developing solution, etc., and various improvements have been made.

SUMMARY OF THE INVENTION

The present invention provides a novel process for forming a color image by heat development and eliminating drawbacks present in known materials.

Therefore, an object of the present invention is to provide a novel process for forming a color image which comprises heat transferring a dye formed upon heat development into an image receiving material containing a mordant to obtain a color image.

Another object of the present invention is to provide a process which can clearly separates the dye formed from unreacted substances.

Still another object of the present invention is to provide a process for forming a clear color image by a simple procedure.

A further object of the present invention is to provide a heat-developable color diffusion transfer photographic material containing a novel 2-equivalent magenta color image forming polymer coupler latex which forms a dye in a high yield without the occurrence of undesirable fog and stain.

These and other objects of the present invention will become more apparent from the following detailed description and examples.

These objects of the present invention are accomplished with a heat-developable color photographic material comprising a support having thereon at least a light-sensitive silver halide, an organic silver salt oxidizing agent, a hydrophilic binder, a reducing agent for the silver halide and/or the organic silver salt oxidizing agent and a magenta color image forming polymer coupler latex which is capable of forming a diffusible dye upon coupling with an oxidized product of the reducing agent and which is a homopolymer or copolymer having a repeating unit derived from a monomer coupler represented by the following general formula (I):

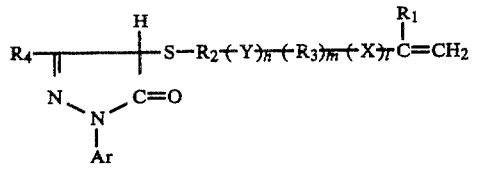

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

DETAILED DESCRIPTION OF THE INVENTION

The heat-developable color photographic material of the present invention can simultaneously provide a silver image having a negative-positive relationship to the original and a dye formed upon the coupling reaction on the part corresponding to the silver image by only carrying out heat development after imagewise exposure to light. That is, when the heat-developable color photographic material of the present invention is imagewise exposed to light and developed by heating, an oxidation-reduction reaction occurs between an organic silver salt oxidizing agent and a reducing agent by means of exposed light-sensitive silver halide as a catalyst to form a silver image in the exposed area. In this step, the polymer coupler latex causes a coupling reaction with an oxidized product of the reducing agent and as a result a magenta dye is formed.

The magenta polymer coupler latex used in the present invention is rendered non-diffusible in a binder since a releasable group is connected to a polymer chain in the polymer coupler latex. On the other hand, the magenta dye formed upon the coupling reaction with the oxidized product of the reducing agent is mobilizable because it is released from the polymer main chain. It is possible to render the dye diffusible in a hydrophilic binder by reducing a molecular weight of the color forming portion and introducing a hydrophilic group thereto, if desired. The diffusible dye thus-formed upon the coupling reaction is transferred to an image receiving material having a mordant layer whereby a color image is obtained.

The 2-equivalent magenta color image forming polymer coupler latex which can be used in the present invention includes a homopolymer having a repeating unit represented by the general formula (II) below derived from a monomer coupler represented by the general formula (I) below, and a copolymer having a repeating unit represented by the general formula (II) below and at least one non-color forming monomer.

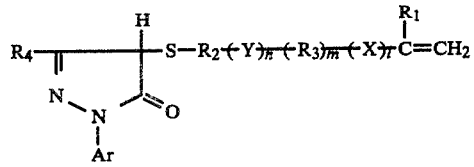

(I)

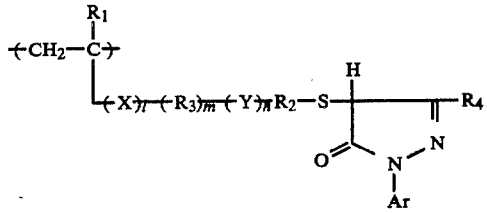

(II)

wherein $R_1$, $R_2$, $R_3$, $R_4$, X, Y, Ar, l, m and n have the same meanings as defined in the general formula (I) above.

The novel 2-equivalent magenta color image forming polymer coupler latex according to the present invention includes a homopolymer having a repeating unit derived from a monomer coupler represented by the general formula (I), and a copolymer having the repeating unit according to formula (II) and at least one non-color forming monomer containing at least one ethylene group which does not have an ability of oxidative coupling with an aromatic primary amine developing agent.

In the above-described formula (I), $R_1$ represents hydrogen, a lower alkyl group having from 1 to 4 carbon atoms, or a chlorine atom; $R_2$ and $R_3$ each represents an unsubstituted or substituted alkylene group, preferably having from 1 to 10 carbon atoms, which may be a straight chain or a branched chain, an unsubstituted or substituted arylene group having from 6 to 10 carbon atoms or an unsubstituted or substituted aralkylene group having from 7 to 10 carbon atoms. Preferred examples of the alkylene group include a methylene group, a methylmethylene group, a dimethylmethylene group, a dimethylene group, a trimethylene group, a tetramethylene group, a pentamethylene group, a hexamethylene group, an octamethylene group, a decylmethylene group, etc. Preferred examples of the arylene group include a phenylene group, a naphthylene group, etc. Preferred examples of the aralkylene group include a benzylidene group, etc.

X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

Substituents for the alkylene group, the arylene group or the aralkylene group represented by $R_2$ and $R_3$ include an aryl group (for example, a phenyl group, etc.), a nitro group, a hydroxy group, a cyano group, a sulfo group, an alkoxy group (for example, a methoxy group, etc.), an aryloxy group (for exampe, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Ar represents an unsubstituted or substituted phenyl group. Substituents for the phenyl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamido group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present, they may be the same or different.

Particularly preferred substituents for the phenyl group include a halogen atom, an alkyl group, an alkoxy group, an alkoxycarbonyl group and a cyano group.

$R_4$ represents an unsubstituted or substituted anilino group, an unsubstituted or substituted acylamino group (for example, an alkylcarbonamido group, a phenylcarbonamido group, an alkoxycarbonamido group, a phenoxycarbonamido group, etc.) or an unsubstituted or substituted ureido group (for example, an alkylureido group, a phenylureido group, etc.). Substituents for these groups include a halogen atom (for example, a fluorine atom, a chlorine atom, a bromine atom, etc.), a straight chain or branched chain alkyl group (for example, a methyl group, a tert-butyl group, an octyl group, a tetradecyl group, etc.), an alkoxy group (for example, a methoxy group, an ethoxy group, a 2-ethylhexyloxy group, a tetradecyloxy group, etc.), an acylamino group (for example, an acetamido group, a benzamido group, a butanamido group, an octanamido group, a tetradecanamido group, an α-(2,4-di-tert-amylphenoxy)acetamido group, an α-(2,4-di-tert-amylphenoxy)-butyramido group, an α-(3-pentadecylphenoxy)hexanamido group, an α-(4-hydroxy-3-tert-butylphenoxy)-tetradecanamido group, a 2-oxopyrrolidin-1-yl group, a 2-oxo-5-tetradecylpyrrolidin-1-yl group, an N-methyltetradecanamido group, etc.), a sulfonamido group (for example, a methanesulfonamido group, a benzenesulfonamido group, an ethylsulfonamido group, a p-toluenesulfonamido group, an octanesulfonamido group, a p-dodecylbenzenesulfonamido group, an N-methyltetradecanesulfonamido group, etc.), a sulfamoyl group (for example, a sulfamoyl group, an N-methylsulfamoyl group, an N-ethylsulfamoyl group, an N,N-dimethylsulfamoyl group, an N,N-dihexylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (for example, an N-methylcarbamoyl group, an N-butylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (for example, an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (for example, a methoxycarbonyl group, a tetradecyloxycarbonyl group, a benzyloxycarbonyl group, etc.), an alkoxysulfonyl group (for example, a methoxysulfonyl group, a butoxysulfonyl group, an octyloxysulfonyl group, a tetradecyloxysulfonyl group, etc.), an aryloxysulfonyl group (for example, a phenoxysulfonyl group, a p-methylphenoxysulfonyl group, a 2,4-di-tert-amylphenoxysulfonyl group, etc.), an alkanesulfonyl group (for example, a methanesulfonyl group, an ethanesulfonyl group, an octanesulfonyl group, a 2-ethylhexylsulfonyl group, a hexadecanesulfonyl group, etc.), an arylsulfonyl group (for example, a benzenesulfonyl group, a 4-nonylbenzenesulfonyl group, etc.), an alkylthio group (for example, a methylthio group, an ethylthio group, a hexylthio group, a benzylthio group, a tetradecylthio group, a 2-(2,4-di-tert-amylphenoxy)ethylthio group, etc.), an arylthio group (for example, a phenylthio group, a p-tolylthio group, etc.), an alkoxycarbonylamino group (for example, a methoxycarbonylamino group, an ethoxycarbonylamino group, a benzyloxycarbonylamino group, a hexadecyloxycarbonylamino group, etc.), an alkylureido group (for example, an N-methylureido group, an N,N-dimethylureido group, an N-methyl-N-dodecylureido group, an N-hexadecylureido group, an N,N-dioctadecylureido group, etc.), an acyl group (for example, an acetyl group, a benzoyl group, an octadecanoyl group, a p-dodecanamidobenzoyl group, etc.), a nitro group, a carboxy group, a sulfo group, a hydroxy group, a trichloromethyl group, and the like.

In the above-described substituents, the alkyl moiety represents preferably an alkyl group having from 1 to 36 carbon atoms and the aryl moiety represents preferably an aryl group having from 6 to 38 carbon atoms.

Examples of the non-color forming ethylenic monomer which does not couple with the oxidation product of an aromatic primary amine developing agent include acrylic acid, α-chloroacrylic acid, an α-alkylacrylic acid (for example, methacrylic acid), an ester and an amide derived from an acrylic acid such as acrylic acid, methacrylic acid or etc. (for example, acrylamide, methacrylamide, tert-butylacrylamide, methyl acrylate, methyl methacrylate, ethyl acrylate, n-propyl acrylate, isopropyl acrylate, n-butyl acrylate, tert-butyl acrylate, n-butyl methacrylate, 2-ethylhexyl acrylate, n-hexyl acrylate, n-octyl acrylate, lauryl acrylate, methylenebisacrylamide, etc.), a vinyl ester (for example, vinyl acetate, vinyl propionate, vinyl laurate, etc.), acrylonitrile, methacrylonitrile, an aromatic vinyl compound (for example, styrene and a derivative thereof, vinyl toluene, divinyl benzene, vinyl acetophenone, sulfostyrene, etc.), itaconic acid, citraconic acid, crotonic acid, vinylidene chloride, a vinyl alkyl ether (for example, vinyl ethyl ether, etc.), an ester of maleic acid, N-vinyl-2-pyrrolidone, N-vinylpyridine, 2- or 4-vinylpyridine, etc.

Of these monomers, an ester of acrylic acid, an ester of methacrylic acid, an ester of maleic acid are particularly preferred.

Two or more non-color forming ethylenically unsaturated monomers described above can be used together. For example, a combination of n-butyl acrylate and divinyl benzene, styrene and methacrylic acid, n-butyl acrylate and methacrylic acid, etc., can be used.

The ethylenically unsaturated monomer which is used to copolymerize with the monomer coupler represented by the above-described general formula (I) can be selected so that the copolymer to be formed possesses good physical properties and/or chemical properties, for example, solubility, compatability with a binder such as gelatin in a photographic colloid composition, flexibility, heat stability, etc., as well known in the field of polymer color couplers.

The magenta polymer coupler latex used in the present invention can be prepared by an emulsion polymerization method as described above, or by dissolving a hydrophobic polymer coupler obtained by polymerization of a monomer coupler in an organic solvent and then dispersing the solution in a latex form in an aqueous gelatin solution. With respect to the emulsion polymerization, the methods as described in U.S. Pat. Nos. 4,080,211 and 3,370,952 and with respect to the method in which a hydrophobic polymer coupler is dispersed in a latex form in an aqueous gelatin solution, the method as described in U.S. Pat. No. 3,451,820 can be employed, respectively. These methods can be applied to preparation of homopolymers and preparation of copolymers. In the latter case, a non-color forming monomer is preferably a liquid monomer which may act, in the case of the emulsion polymerization, as a solvent for a monomer which is normally solid.

Free radical polymerization of an ethylenically unsaturated solid monomer is initiated with the addition to the monomer molecule of a free radical which is formed by thermal decomposition of a chemical initiator, an action of a reducing agent to an oxidative compound (a redox initiator) or a physical action, for example, irradiation of ultraviolet rays or other high energy radiations, high frequencies, etc.

Examples of the chemical initiators commonly used include a water-soluble initiator, for example, a persulfate (such as ammonium persulfate, potassium persulfate, etc.), hydrogen peroxide, 4,4'-azobis(4-cyanovaleric acid), etc., and a water-insoluble initiator, for example, azoisobutyronitrile (such as 2,2'-azobis(2,4-dimethylvaleronitrile), 2,2'-azobisisobutyronitrile, etc.), benzoyl peroxide, chlorobenzoyl peroxide, and other compounds. Examples of the redox initiators usually used include hydrogen peroxide-iron (II) salt, potassium persulfate-potassium hydrogensulfate, cerium salt-alcohol, etc. Specific examples and functions of the initiators are described in F. A. Bovey, *Emulsion Polymerization,* pages 59–93 (Interscience Publisher Inc., New York (1955)).

As an emulsifier which can be used in the emulsion polymerization, a compound having surface activity is used. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16–20 (1963).

On the other hand, an organic solvent which is used for dissolving a hydrophobic polymer coupler in the case where the hydrophobic polymer coupler is dispersed in a latex form in an aqueous gelatin solution is removed from the mixture by vaporization before coating of the dispersion solution or during drying of the dispersion solution coated, although the latter is less preferable. With respect to removing the solvent, a method in which the solvent is removed by washing a gelatin noodle with water is applied when the solvent is water-soluble to some extent, or a spray drying method, a vacuum purging method or a steam purging method can be employed for removing the solvent.

Examples of the organic solvents which can be removed include, for example, a lower alkyl ester, a lower alkyl ether, ketone, halogenated hydrocarbon (for example, methylene chloride, trichloroethylene, a fluorinated hydrocarbon, etc.), an alcohol (for example, an alcohol between n-butyl alcohol and octyl alcohol, etc.), and a mixture thereof.

Any type of dispersing agent can be used in the dispersion of the hydrophobic polymer coupler. Ionic surface active agents, and particularly anionic surface active agents are preferred. Amphoteric surface active agents such as C-cetyl betaine, an N-alkylaminopropionate, an N-alkyliminodipropionate, etc., can also be used.

In order to increase the dispersion stability, control the color hue of a dye formed from a polymer coupler latex dispersed and the oxidation product of an aromatic primary amine developing agent and improve the bending property of the emulsion coated, a permanent solvent, that is, a water-immiscible organic solvent having a high boiling point (i.e., above 200° C.), may be added. The concentration of the permanent solvent must be at such a low level that the copolymer is plasticized while it is maintained in solid particle form. Furthermore, it is desirable to use the permanent solvent in a relatively low concentration in order to reduce the thickness of a final emulsion layer as much as possible to obtain good sharpness.

It is desirable if the ratio of the color forming portion in the polymer coupler latex is usually from 5 to 80% by weight. Particularly, a ratio from 20 to 70% by weight is preferred in view of color reproducibility, color forming property and stability. In this case, an equivalent molecular weight, that is, a gram number of the polymer containing 1 mol of a monomer coupler, is preferably from about 250 to 3,000 but it is not limited thereto.

Preferred specific examples of the monomer couplers used in the present invention are set forth below, but the present invention is not to be construed as being limited thereto.

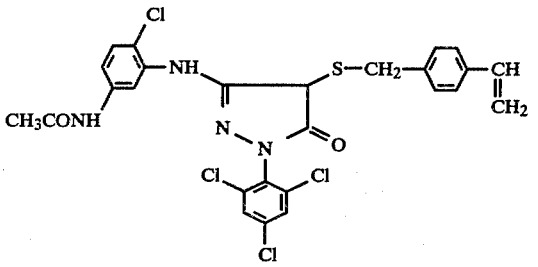

(1)

-continued
(2)
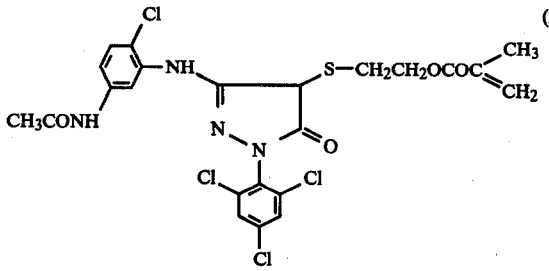
(3)
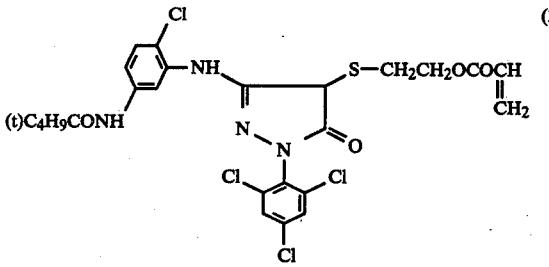
(4)
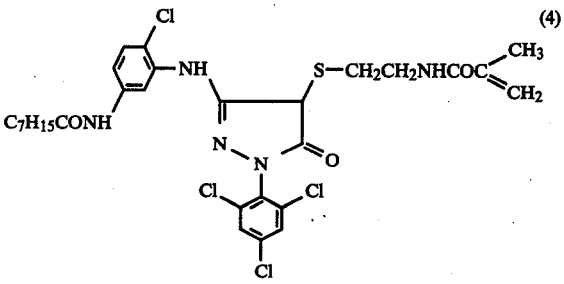
(5)
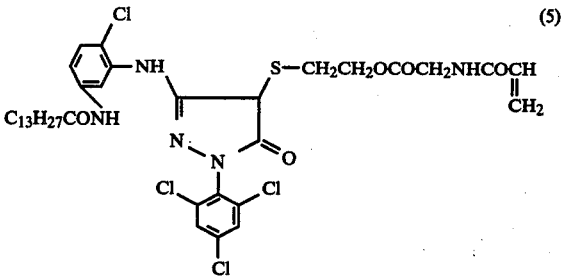
(6)
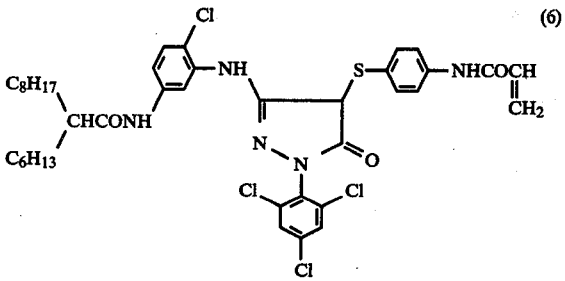
(7)
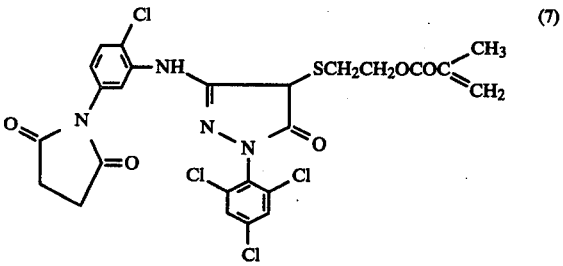
-continued
(8)
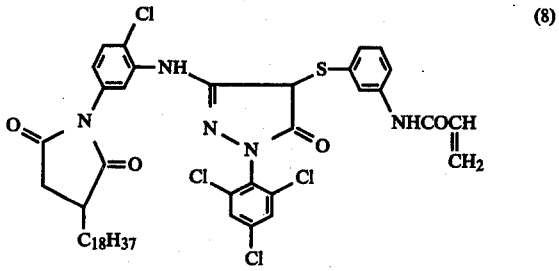
(9)
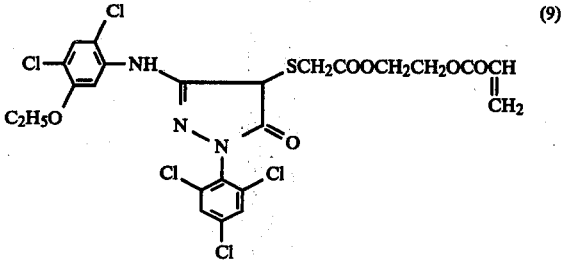
(10)
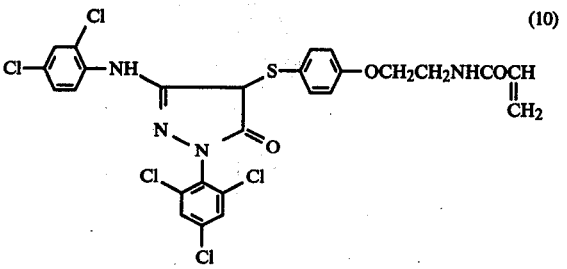
(11)
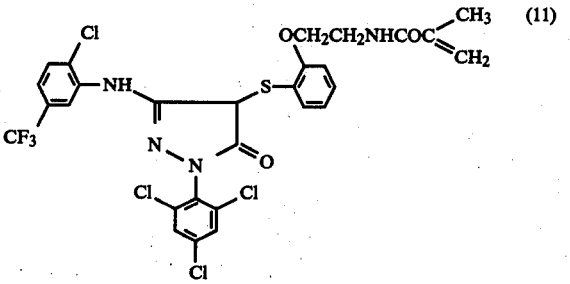
(12)
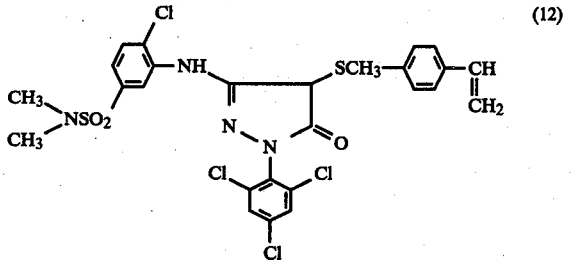
(13)
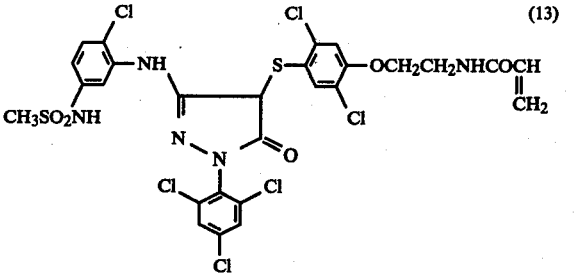

-continued
(14)
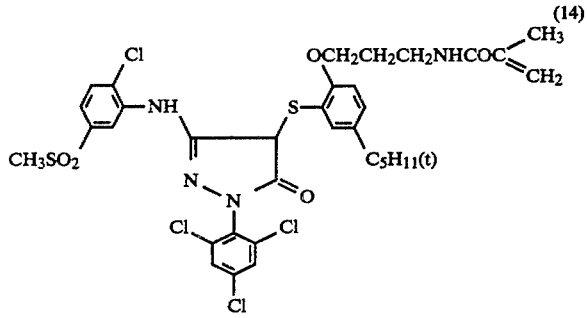
(15)
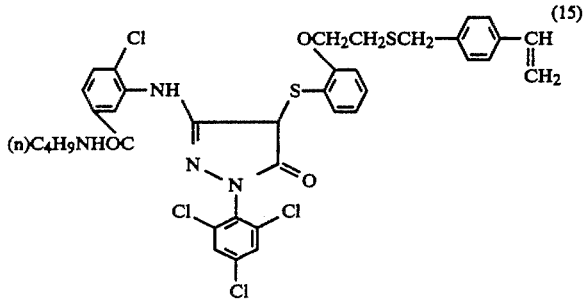
(16)
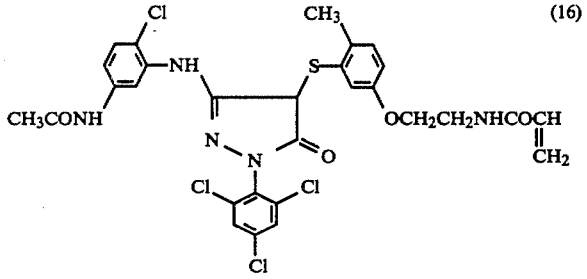
(17)
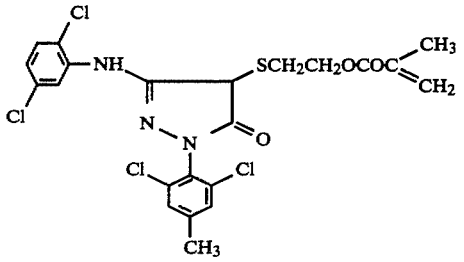
(18)
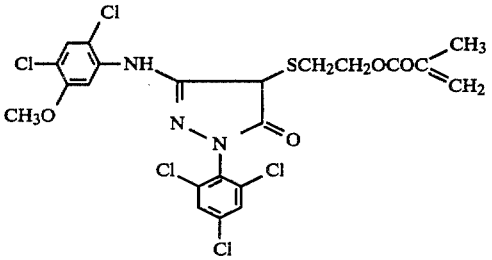
-continued
(19)
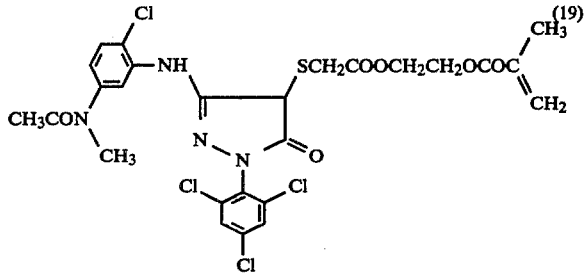
(20)
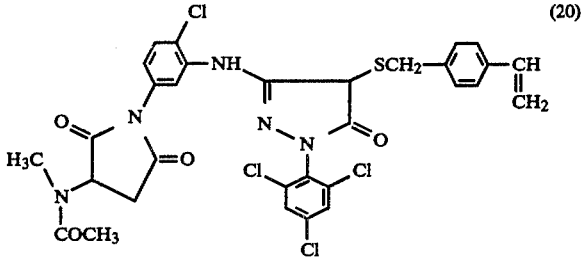
(21)
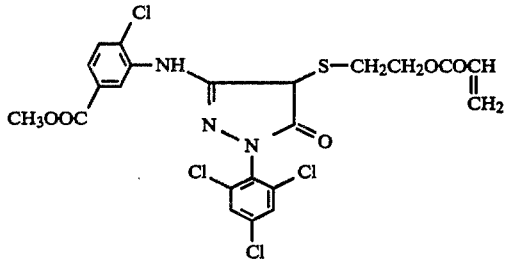
(22)
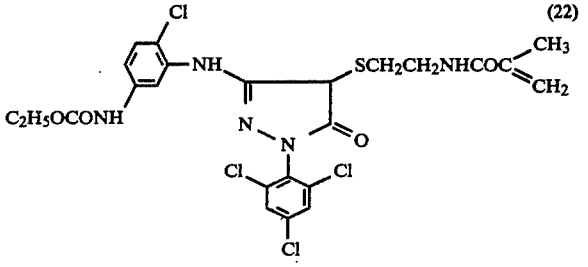
(23)
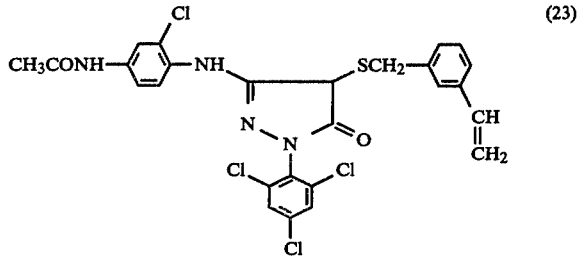
(24)
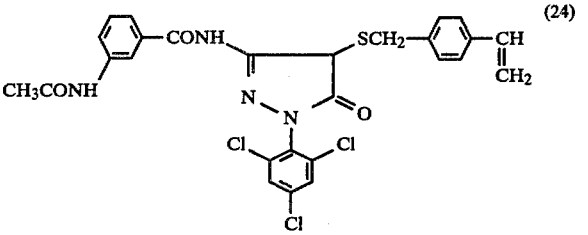

-continued
(25)
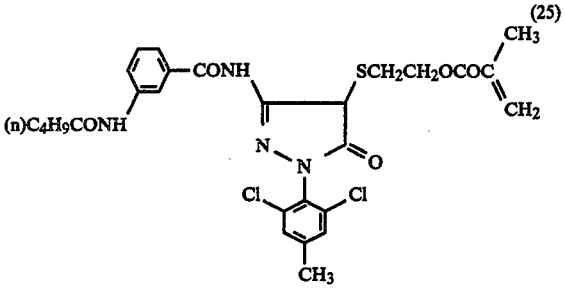
(26)
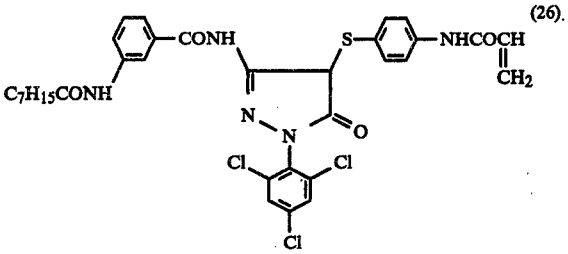
(27)
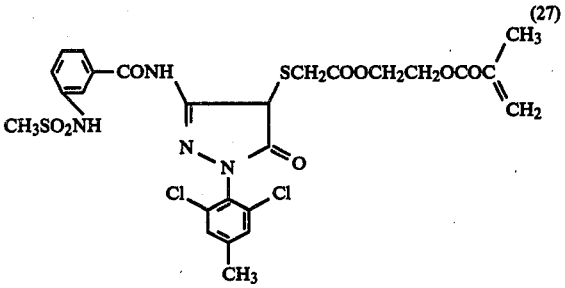
(28)
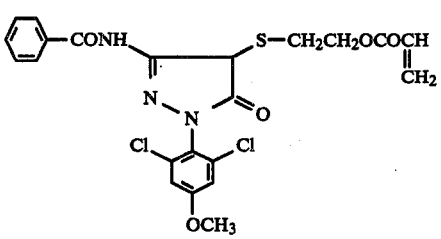
(29)
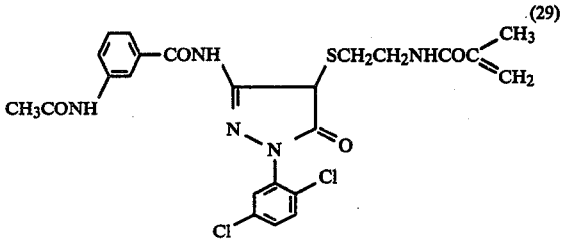
(30)
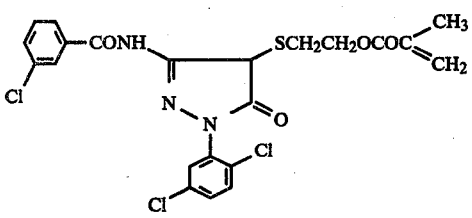
-continued
(31)
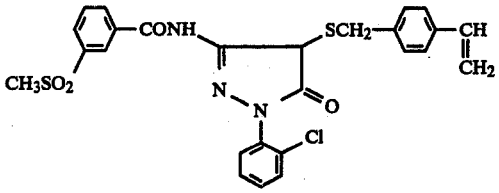
(32)
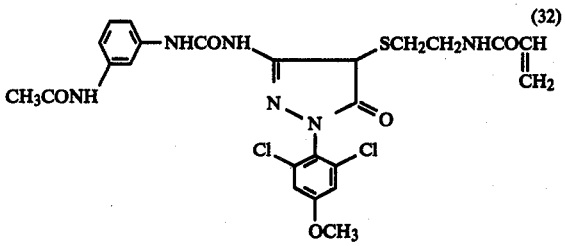
(33)
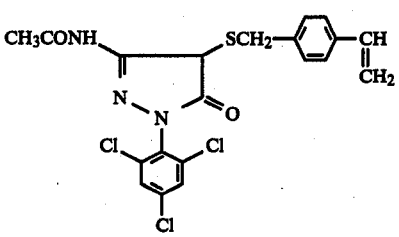
(34)
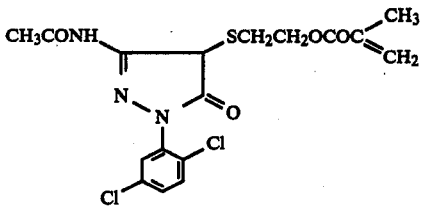
(35)
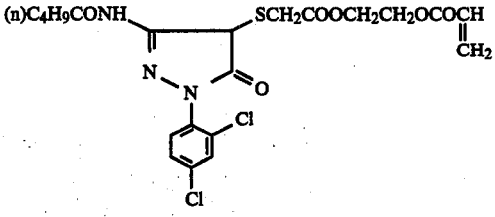
(36)
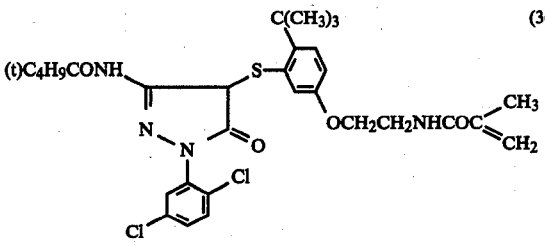
(37)
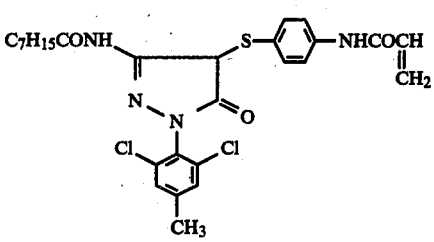

-continued

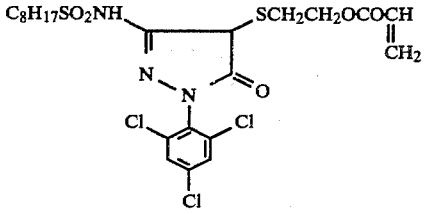

(38)

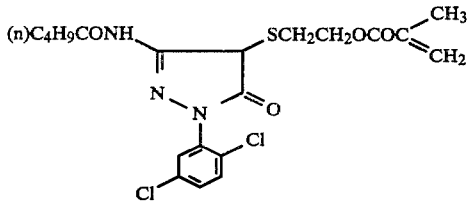

(39)

The monomer couplers used in the present invention can be synthesized in accordance with the methods as described in Japanese Patent Application (OPI) Nos. 25056/80, 29805/80 and 62454/80, U.S. Pat. No. 4,351,897, etc.

More specifically, compounds in which a coupling releasable group is a thiophenol derivative can be synthesized according to the following methods.

1. A thiophenol derivative or a corresponding disulfide is converted into a sulphenyl halide by treatment with a halogenating agent (for example, chlorine, bromine, sulfuryl chloride, N-bromosuccinimide, etc.), and then the sulphenyl halide is reacted with a 4-equivalent coupler in the presence of a basic catalyst, or in the absence of a catalyst, to introduce the arylthio group to the coupling active position of the coupler as set forth in Reaction Scheme I below. This method can also be conducted by the addition of a halogen to a mixture of a thiophenol derivative and a 4-equivalent coupler.

Reaction Scheme I

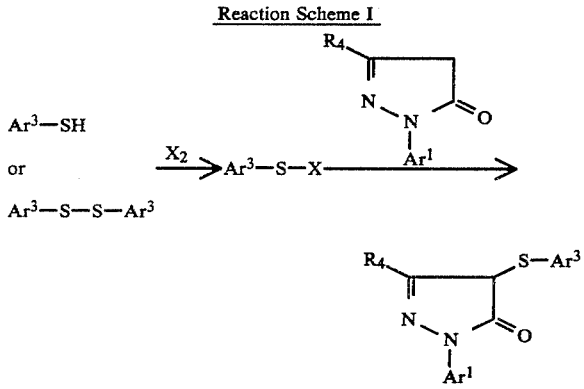

2. After the active position of a 4-equivalent coupler is treated with a halogenating agent and the resulting halogen substituted compound is reacted with a thiophenol derivative in the presence of a basic catalyst, or in the absence of a catalyst, to introduce the arylthio group to the coupling active position of the coupler as set forth in Reaction Scheme II below. This method can be applied to a 4-equivalent coupler having an anilino group at the 3-position of the pyrazolone ring. In such a case, after the amino group is protected by acylation (for example, an acetyl group, an ethoxycarbonyl group, etc.), the arylthio group is introduced in the same manner as described above and then the protective group is removed to obtain the desired coupler.

Reaction Scheme II

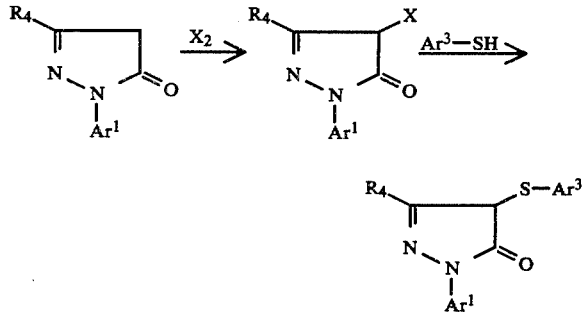

Case of 3-anilino group:

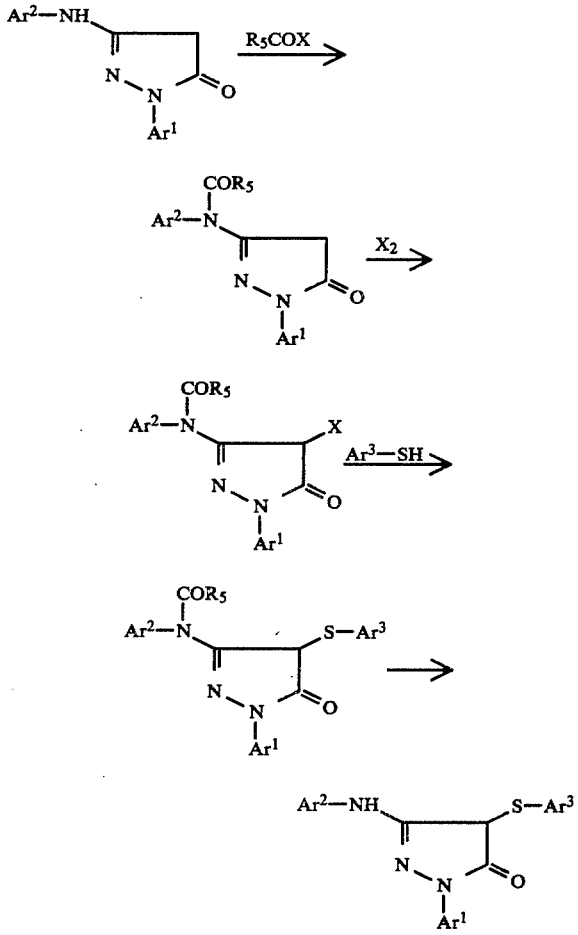

The thiophenol derivative or the corresponding disulfide, which is the source of the coupling releasable group, can be synthesized according to the following methods.

A corresponding aniline derivative is reacted with sodium nitrite under an acidic condition to form the diazonium salt, and then the latter is reacted with sodium sulfide or sodium disulfide to obtain a thiophenol derivative or a corresponding disulfide, respectively, as set forth in Reaction Scheme III below.

Reaction Scheme III

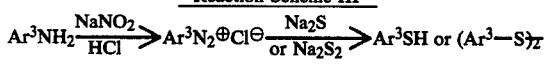

A benzene derivative including a substituent suited for the purpose of the present invention is chlorosulfonated with chlorosulfonic acid, and then the resulting compound is reduced using metallic zinc or metallic tin together with an acid, to obtain a thiophenol derivative as set forth in Reaction Scheme IV below.

Reaction Scheme IV

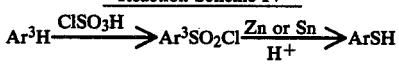

This method is applicable to a sulfonyl chloride which is produced by reaction of a corresponding sulfonic acid with thionyl chloride, phosphorus oxychloride etc., when an appropriate sulfonic acid is available as a starting material. Also, it is possible to obtain a corresponding disulfide using hydrogen iodide as a reducing agent.

After converting a corresponding phenol derivative to a sodium salt, the latter is reacted with dimethylthiocarbamoyl chloride to form a dimethylthiocarbamate, and the resulting compound is subjected to heat rearrangement and hydrolysis through a dimethyl thiolcarbamate to obtain a thiophenol derivative as set forth in Reaction Scheme V below. This method is described in *J. Org. Chem.*, Vol. 31, p. 3980 (1956).

Reaction Sheme V

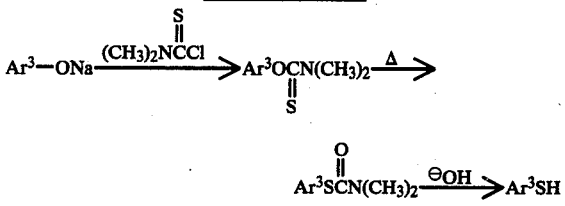

Further, compounds in which a coupling releasable group is an alkylthio derivative can be synthesized according to the following methods.

1. An S-alkylisothiourea derivative hydrochloride is reacted with a 4-equivalent coupler to introduce the alkylthio group to the coupling active position of the coupler as set forth in Reaction Scheme VI below.

Reaction Scheme VI

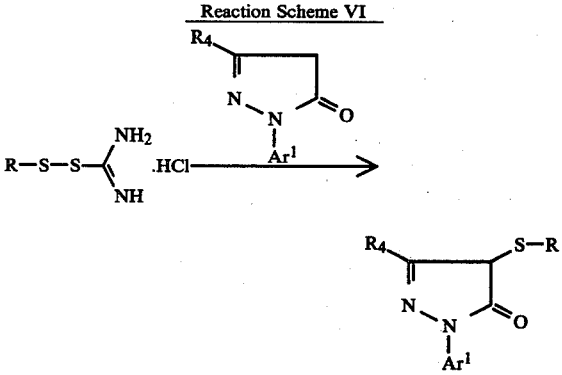

2. A magenta coupler having a halogen atom at the coupling position is reacted with thiourea and then the resulting isothiouronium salt is reacted with an alkyl halide derivative in the presence of a base to introduce the alkylthio group to the coupling active position of the coupler as set forth in Reaction Scheme VII below. This method can also be conducted by the addition of a halogen to a mixture of a 4-equivalent coupler and a thiourea to prepare an isothiuronium salt.

Reaction Scheme VII

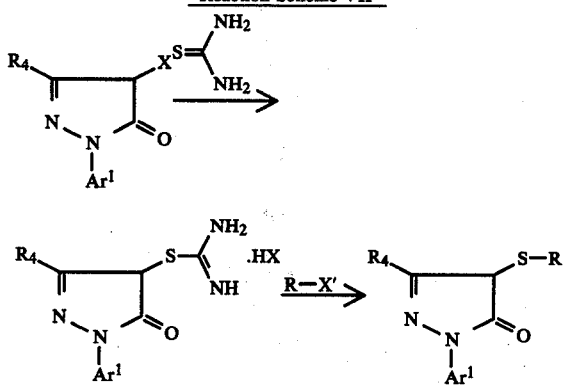

The introduction of a polymerizable functional group (i.e., an ethylene group) to the portion of coupling releasable group can be carried out either before or after the introduction of the coupling releasable group to a 4-equivalent coupler.

Synthesis examples of the representative couplers according to the present invention are set forth below, but the present invention should not be construed as being limited thereto.

A. Monomer Compounds

SYNTHESIS EXAMPLE 1

Synthesis of 1-(2,4,6-trichlorophenyl)-3-(2-chloro-5-acetamidoanilino)-4-(4-vinylbenzylthio)-5-oxo-2-pyrazoline [Monomer Coupler (1)]

89 g (0.2 mol) of 1-(2,4,6-trichlorophenyl)-3-(2-chloro-5-acetamidoanilino)-5-oxo-2-pyrazoline and 16 g (0.21 mol) of thiourea were dissolved in 200 ml of dimethylformamide. 38.4 g (0.24 mol) of bromine was added dropwise to the solution with stirring over a period of about 30 minutes at from 20° C. to 30° C. and the mixture was further stirred for 1 hour. The reaction solution was poured into 3 liters of water, the solid thus-deposited was collected by filtration and dried to obtain 102.3 g of the isothiuronium salt (hydrobromide).

90 g (0.15 mol) of the isothiuronium salt thus-obtained was dissolved in 150 ml of dimethylacetamide. To the solution was added a solution containing 42 g (0.75 mol) of potassium hydroxide dissolved in 80 ml of methanol while introducing a nitrogen gas therein. After stirred for 3 hours at room temperature, 5 ml of nitrobenzene and 27.5 g (0.18 mol) of p-chloromethylstyrene were gradually added while cooling with water and then 3 g of potassium iodide was added. After further stirring for 3.5 hours, the mixture was neutralized with 25 ml of acetic acid, 1 liter of water was added thereto and extracted with ethyl acetate. The extract was washed with water and dried with anhydrous sodium sulfate. The ethyl acetate was distilled off under a reduced pressure and to the residue was added acetonitrile. The crystals thus-deposited were collected by filtration and recrystallization from a solvent mixture of acetonitrile and ethanol (3:1 by volume) to obtain 57.4 g (66.6% yield) of Monomer Coupler (1) having a melting point of 240° C.

SYNTHESIS EXAMPLE 2

Synthesis of
1-(2,4,6-trichlorophenyl)-3-acetylamino-4-(4-vinylbenzylthio)-5-oxo-2-pyrazoline [Monomer Coupler (33)]

64 g (0.2 mol) of 1-(2,4,6-trichlorophenyl)-3-acetylamino-5-oxo-2-pyrazoline and 16 g (0.21 mol) of thiourea were dissolved in 130 ml of dimethylformamide. 38.4 g (0.24 mol) of bromine was added dropwise to the solution with stirring over a period of about 30 minutes at about 25° C. and the mixture was further stirred for 1 hour. The reaction solution was poured into water and separated by adding ethyl acetate. The aqueous layer was neutralized by adding 50 g of sodium hydrogen carbonate and allowed to stand for 15 hours. The solid thus-deposited was collected by filtration and dried to obtain 53.5 g of the isothiuronium salt (carbonate). 45.5 g (0.1 mol) of the isothiuronium salt thus-obtained was dissolved in 100 ml of dimethylacetamide. To the solution was added a solution containing 28 g (0.5 mol) of potassium hydroxide dissolved in 60 ml of methanol while introducing a nitrogen gas therein. After stirring for 1.5 hours at room temperature, 5 ml of nitrobenzene and 18.3 g (0.12 mol) of p-chloromethylstyrene were gradually added while cooling with water and then 2 g of potassium iodide was added. After further stirring for 5 hours, the mixture was neutralized with 15 mol of acetic acid, 1 liter of water was added thereto and extracted with ethyl acetate. The extract was washed with water and dried with anhydrous sodium sulfate. The ethyl acetate was distilled off under a reduced pressure and the residue was separated and purified by a silica gel column chromatography to obtain 24.1 g (51.3% yield) of oily Monomer Coupler (33).

SYNTHESIS EXAMPLE 3

Synthesis of
1-(2,5-dichlorophenyl)-3-acetylamino-4-methacryloyloxyethylthio-5-oxo-2-pyrazoline [Monomer Coupler (34)]

57.2 g (0.2 mol) of 1-(2,5-dichlorophenyl)-3-acetylamino-5-oxo-2-pyrazoline and 16 g (0.21 mol) of thiourea were dissolved in 200 ml of dimethylformamide. 38.4 g (0.24 mol) of bromine was added dropwise to the solution with stirring over a period of about 30 minutes at 25° C. and the mixture was further stirred for 1 hour. The reaction solution was poured into 3 liters of water, the solid thus-deposited was collected by filtration and dried to obtain 69.1 g of the isothiuronium salt.

66.5 g (0.15 mol) of the isothiuronium salt thus-obtained was dissolved in 150 ml of dimethylacetamide. To the solution was added a solution containing 28 g (0.5 mol) of potassium hydroxide dissolved in 60 ml of methanol while introducing a nitrogen gas therein. After stirring for 3 hours at room temperature, 22.5 g (0.18 mol) of $\beta$-bromoethanol was added while cooling with water and then 2.5 g of potassium iodide was added. After further stirring for 5 hours, the mixture was neutralized with 15 ml of acetic acid, 1 liter of water was added thereto and extracted with ethyl acetate. The extract was washed with water and dried with anhydrous sodium sulfate. The ethyl acetate was distilled off under a reduced pressure and 29.7 g of the 4-hydroxyethylthio derivative was obtained as an oily product.

25.4 g (0.07 mol) of the hydroxyethylthio derivative thus-obtained was dissolved in 150 ml of tetrahydrofuran. To the solution were added 21.8 ml (0.28 mol) of pyridine and 1 ml of nitrobenzene and then to the mixture was added 18.3 g (0.175 mol) of methacrylic chloride with thoroughly stirring while cooling with ice. The mixture was stirred for 2 hours, to the solution was added water, and extracted with ethyl acetate. The extract was washed with water and dried with anhydrous sodium sulfate. The ethyl acetate was distilled off under a reduced pressure, the residue obtained was dissolved in 200 ml of ethanol, to which was added 5 ml of a 30% aqueous ammonia and stirred for 30 minutes. After neutralizing with acetic acid, 300 ml of water was added and extracted with ethyl acetate. The extract was washed with water and dried with anhydrous sodium sulfate. The ethyl acetate was distilled off under a reduced pressure, the residue was separated and purified by a silica gel column chromatography to obtain 13.0 g (43.3% yield) of oily Monomer Coupler (34).

B. Polymer Compounds

Synthesis Method I

SYNTHESIS EXAMPLE 4

Copolymer latex of
1-(2,4,6-trichlorophenyl)-3-(2-chloro-5-acetamidoanilino)-4-(4-vinylbenzylthio)-5-oxo-2-pyrazoline [Monomer Coupler (1)] and n-butyl acrylate [Polymer Coupler latex (A)]

2 liters of an aqueous solution containing 2 g of sodium salt of oleyl methyl tauride dissolved was stirred and heated to 95° C. while gradually introducing a nitrogen gas through the solution. To the mixture was added 40 ml of an aqueous solution containing 280 mg of potassium persulfate dissolved. 30 g of n-butyl acrylate and 10 g of Monomer Coupler (1) were dissolved by heating in 400 ml of ethanol and the resulting solution was added to the above-described aqueous solution at an interval of about 30 minutes while preventing the deposition of crystals. After the completion of the addition, the mixture was heated at from 85° C. to 95° C. with stirring for 45 minutes, to which was then added 40 ml of an aqueous solution containing 120 mg of potassium persulfate dissolved. After being reacted for 1 hour, the n-butyl acrylate not reacted were distilled off as an azeotropic mixture with water. The latex thus-formed was cooled, pH of which was adjusted to 6.0 with a 1 N sodium hydroxide solution and filtered. The concentration of the polymer in the latex was 11.35% and it was found that the copolymer synthesized contained 24.3% of Monomer Coupler (1) as the result of nitrogen analysis.

SYNTHESIS EXAMPLE 5

Copolymer latex of
1-(2,4,6-trichlorophenyl)-3-(2,4-dichloro-5-methoxyanilino)-4-methacryloyloxyethylthio-5-oxo-2-pyrazoline [Monomer Coupler (18)] and ethyl acrylate [Polymer Coupler Latex (B)]

2 liters of an aqueous solution containing 2 g of sodium salt of oleyl methyl tauride dissolved was stirred and heated to 95° C. while introducing a nitrogen gas through the solution. To the mixture was added 40 ml of an aqueous solution containing 280 mg of potassium persulfate dissolved. 30 g of ethyl acrylate and 10 g of Monomer Coupler (18) were dissolved by heating in 400 ml of ethanol and the resulting solution was added to the above-described aqueous solution at an interval of about 30 minutes while preventing the deposition of crystals. After the completion of the addition, the mixture was heated at from 85° C. to 95° C. with stirring for 45 minutes, to which was then added 40 ml of an aqueous solution containing 120 mg of potassium persulfate dissolved. After being reacted for 1 hour, the ethyl acrylate not reacted was distilled off as an azeotropic mixture with water. The latex thus-formed was cooled, pH of which was adjusted to 6.0 with a 1 N sodium hydroxide solution and filtered. The concentration of the polymer in the latex was 11.02% and it was found that the copolymer synthesized contained 27.8% of Monomer Coupler (18) as the result of nitrogen analysis.

SYNTHESIS EXAMPLE 6

Copolymer latex of 1-(2,5-dichlorophenyl)-3-acetylamino-4-methacryloyloxyethylthio-5-oxo-2-pyrazoline [Monomer Coupler (34)] and n-butyl acrylate [Polymer Coupler Latex (C)]

270 ml of an aqueous solution containing 1.54 g of sodium salt of oleyl methyl tauride dissolved was stirred and heated to 95° C. while introducing a nitrogen gas through the solution. To the mixture were added 20 ml of an aqueous solution containing 28 mg of potassium persulfate dissolved, and then 2.8 g of n-butyl acrylate. The mixture was polymerized by heating at from 85° C. to 90° C. with stirring for about 1 hour to prepare Latex (a). Then, to Latex (a) were added 10 g of Monomer Coupler (34), 100 ml of ethanol and 10 ml of an ethanol solution containing 18 g of n-butyl acrylate dissolved. To the mixture was then added 50 ml of an aqueous solution containing 196 mg of potassium persulfate dissolved and the mixture was polymerized by heating with stirring. After being reacting for 1 hour, 30 ml of an aqueous solution containing 84 mg of potassium persulfate was further added to the mixture and the mixture was continuously reacted for 1.5 hours. The ethanol and the n-butyl acrylate not reacted were distilled off as an azeotropic mixture with water. The latex thus-formed was cooled, pH of which was adjusted to 6.0 with a 1 N sodium hydroxide solution and filtered. The concentration of the polymer in the latex was 10.7% and it was found that the copolymer synthesized contained 33.5% of Monomer Coupler (34) as the result of nitrogen analysis.

Synthesis Method II

SYNTHESIS EXAMPLE 7

Synthesis of copolymer coupler of 1-(2,4,6-trichlorophenyl)-3-acetylamino-4-(4-vinylbenzylthio)-5-oxo-2-pyrazoline [Monomer Coupler (33)] and methyl acrylate [Hydrophobic Polymer Coupler (I)]

10 g of Monomer Coupler (33) and 30 g of methyl acrylate were added to 150 ml of dioxane and dissolved by heating at 85° C. To the solution was added 350 mg of 2,2'-azobis(2,4-dimethylvaleronitrile) dissolved in 10 ml of dioxane, the mixture was heated for about 3 hours and further heated at 95° C. for 2 hours. The resulting solution was then poured into 2 liters of ice water and the solid thus-deposited was collected by filtration and thoroughly washed with water. By drying the solid under a reduced pressure with heating, 38.4 g of Hydrophobic Polymer Coupler (I) was obtained. It was found that the hydrophobic polymer coupler contained 28.9% of Monomer Coupler (33) in the copolymer synthesized as the result of nitrogen analysis.

A method for dispersing Hydrophobic Polymer Coupler (I) in an aqueous gelatin solution in a form of latex is described in the following.

Synthesis of Polymer Coupler Latex (I')

Two solutions (a) and (b) were prepared in the following manner.

Solution (a): 300 g of a 5.0% by weight aqueous solution of bone gelatin (pH of 5.6 at 35° C.) was heated to 32° C. and to which was added 12 ml of a 10% by weight aqueous solution of sodium lauryl sulfate.

Solution (b): 30 g of the hydrophobic polymer coupler described above was dissolved in 60 g of ethyl acetate at 38° C.

Solution (b) was put into a mixer with explosion preventing equipment while stirring at a high speed to which was rapidly added Solution (a). After stirring for 1 minute, the mixture was stopped and ethyl acetate was removed by distillaton under a reduced pressure. Thus, the hydrophobic polymer coupler was dispersed in a diluted gelatin solution to prepare Polymer Coupler Latex (I').

SYNTHESIS EXAMPLE 8

Synthesis of copolymer coupler of 1-(2,5-dichlorophenyl)-3-(3-acetamidobenzamido)-4-methacryloylaminoethylthio-5-oxo-2-pyrazolone [Monomer Coupler (29)] and n-octyl acrylate [Hydrophobic Polymer Coupler (II)]

20 g of Monomer Coupler (29) and 20 g of n-octylacrylate were added to 150 ml of tertiary butanol and the mixture was refluxed by heating with stirring. To the mixture was added 350 mg of azobisisobutyronitrile dissolved in 10 ml of tertiary butanol and the mixture was further refluxed by heating for about 3 hours. The resulting solution was then poured into 2 liters of ice water and the solid thus-deposited was collected by filtration and thoroughly washed with water. The solid was dissolved in ethyl acetate and reprecipitated with n-hexane. By drying the solid under a reduced pressure with heating, 37.6 g of Hydrophobic Polymer Coupler (II) was obtained. It was found that the hydrophobic polymer coupler contained 48.6% of Monomer Coupler (29) in the copolymer synthesized as the result of nitrogen analysis.

Synthesis of Polymer Coupler Latex (II')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10.0% by weight aqueous solution of sodium lauryl sulfate.

Solution (b): 20 g of Hydrophobic Polymer Coupler (II) described above was dissolved in 200 ml of ethyl acetate at 38° C.

Solution (b) was put into a mixer with explosion preventing equipment while stirring at high speed and to which was rapidly added Solution (a). After stirring for 1 minute, the mixture was stopped and ethyl acetate was removed by distillaton under a reduced pressure. Thus, the hydrophobic polymer coupler was dispersed in a diluted gelatin solution to prepare Polymer Coupler Latex (II').

below were prepared in the same manner as described for the copolymers in Synthesis Examples 7 and 8 (Synthesis Method II).

| Hydrophobic Polymer Coupler by Synthesis Method II | | | | | | |
|---|---|---|---|---|---|---|
| Synthesis Example | Hydrophobic Polymer Coupler | Monomer Coupler | Amount (g) | Monomer*1 | Amount (g) | Monomer Coupler Unit in Polymer (wt %) |
| 28 | (III) | (2) | 15 | BA | 35 | 29.3 |
| 29 | (IV) | (2) | 15 | BA/AA | 32.5/2.5 | 28.9 |
| 30 | (V) | (7) | 20 | MA | 20 | 55.3 |
| 31 | (VI) | (10) | 10 | BA | 40 | 18.5 |
| 32 | (VII) | (18) | 20 | EHA | 20 | 49.4 |
| 33 | (VIII) | (24) | 15 | BA | 35 | 28.7 |
| 34 | (IX) | (24) | 10 | MA | 20 | 37.1 |
| 35 | (X) | (26) | 20 | PA | 20 | 50.3 |
| 36 | (XI) | (29) | 15 | BA | 35 | 30.1 |
| 37 | (XII) | (30) | 15 | OA | 35 | 29.8 |
| 38 | (XIII) | (32) | 20 | EMA | 20 | 32.3 |
| 39 | (XIV) | (33) | 15 | BA | 35 | 29.7 |
| 40 | (XV) | (34) | 15 | BA | 35 | 30.5 |
| 41 | (XVI) | (36) | 15 | BA | 35 | 30.9 |
| 42 | (XVII) | (39) | 15 | BA | 35 | 29.6 |
| 43 | (XVIII) | (39) | 20 | HA | 20 | 49.7 |

*1MA: Methyl Acrylate HA: n-Hexyl Acrylate
EMA: Ethyl Methacrylate OA: n-Octyl Acrylate
PA: n-Propyl Acrylate EHA: 2-Ethylhexyl Acrylate
BA: n-Butyl Acrylate AA: Acrylic Acid

SYNTHESIS EXAMPLES 9 TO 27

Using the above-described monomer couplers, the magenta copolymer coupler latexes described below were prepared in the same manner as described for the copolymers in Synthesis Examples 4 to 6 (Synthesis Method I).

The amounts of the monomer couplers and the monomers in the above table indicate amounts used in the synthesis of the polymer coupler latexes.

Dispersion of these hydrophobic polymer couplers can be carried out in the same manner as described in Synthesis Examples 7 and 8 and specific methods are described in the examples hereinafter.

| Polymer Coupler Latexes by Synthesis Method I | | | | | | |
|---|---|---|---|---|---|---|
| Synthesis Example | Polymer Coupler Latex | Monomer Coupler | Amount (g) | Monomer*1 | Amount (g) | Monomer Coupler Unit in Polymer (wt %) |
| 9 | (D) | (1) | 10 | BA | 40 | 19.4 |
| 10 | (E) | (1) | 10 | MA | 40 | 22.7 |
| 11 | (F) | (2) | 10 | BA | 40 | 19.7 |
| 12 | (G) | (2) | 10 | BA/MAA | 37.5/2.5 | 19.9 |
| 13 | (H) | (3) | 10 | EA | 20 | 35.2 |
| 14 | (I) | (5) | 20 | MA | 20 | 53.7 |
| 15 | (J) | (7) | 10 | BA | 40 | 18.7 |
| 16 | (K) | (10) | 10 | BMA | 20 | 32.8 |
| 17 | (L) | (14) | 10 | BA | 40 | 20.2 |
| 18 | (M) | (16) | 10 | BA | 40 | 20.7 |
| 19 | (N) | (17) | 20 | OA | 20 | 49.3 |
| 20 | (O) | (18) | 10 | BA | 40 | 19.1 |
| 21 | (P) | (18) | 20 | EHA | 20 | 47.4 |
| 22 | (Q) | (19) | 10 | BA | 40 | 18.6 |
| 23 | (R) | (19) | 20 | ST | 10 | 65.5 |
| 24 | (S) | (24) | 15 | BA | 35 | 30.4 |
| 25 | (T) | (26) | 20 | PA | 20 | 51.6 |
| 26 | (U) | (33) | 15 | BA | 35 | 30.1 |
| 27 | (V) | (34) | 15 | BA | 35 | 29.8 |

*1MA: Methyl Acrylate BMA: n-Butyl Methacrylate
EA: Ethyl Acrylate OA: n-Octyl Acrylate
PA: n-Propyl Acrylate EHA: 2-Ethylhexyl Acrylate
BA: n-Butyl Acrylate ST: Styrene
MAA: Methacrylic Acid The amounts of the monomer couplers and the monomers in the above table indicate amounts used in the synthesis of the polymer coupler latexes.

SYNTHESIS EXAMPLES 28 TO 43

Using the above-described monomer couplers, the hydrophobic magenta polymer couplers described The polymer coupler latex which can be used in the present invention can be employed in the range of from 0.01 mol to 4 mols and, preferably, from 0.1 mol to 1 mol per mol of silver calculated as a mole number of the coupler component.

The organic silver salt oxidizing agent used in the present invention is contained in an amount in the range of from 0.01 mol to 100 mols and, preferably, from 0.2 mol to 10 mols per mol of the light-sensitive silver halide.

Examples of silver halide include silver chloride, silver chlorobromide, silver chloroiodide, silver bromide, silver iodobromide, silver chloroiodobromide and silver iodide, etc.

The silver halide may be used in a combination of two or more which are each different on size and/or halogen composition.

The silver halide has a particle size of from 0.001 μm to 10 μm and, preferably, from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pp. 149 to 169.

The organic silver salt oxidizing agent which can be used in the present invention is a silver salt which forms a silver image by reacting with the above-described image forming compound or a reducing agent coexisting, if necessary, with the image forming compound, when it is heated to a temperature of above 80° C. and, preferably, above 100° C. in the presence of exposed silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver adipate, silver sebacate, silver succinate, silver acetate, silver butyrate and silver camphorate, etc. These silver salts which are substituted with a halogen atom or a hydroxyl group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioehter group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycolic acid (wherein the alkyl group has from 12 to 22 carbon atoms) as described in Japanese Patent Application (OPI) No. 28221/73, a silver salt of dithiocarboxylic acid such as a silver salt of dithioacetate acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are examples of the organic metal salt oxidizing agent capable of being used in the present invention.

The organic silver salt oxidizing agent preferably includes a silver salt of a carboxylic acid derivative and an N-containing heterocyclic compound.

The mechanism of the heat development process under heating in the present invention is not entirely clear, but it is believed to be as follows.

When the photographic material is exposed to light, a latent image is formed in a light-sensitive silver halide. This phenomenon is described in T. H. James, *The Theory of the Photographic Process,* Third Edition, pages 105 to 148.

When the photographic material is heated, the reducing agent reduces the organic metal salt oxidizing agent in the presence of the latent image nuclei as a catalyst to form silver, while it is oxidized itself. The oxidized product of the reducing agent reacts with the magenta polymer coupler latex (the so-called oxidative coupling) whereby a dye is formed.

The silver halide and the organic silver salt oxidizing agent which form a starting point of development should be present within a substantially effective distance.

For this purpose, it is desired that the silver halide and the organic silver salt oxidizing agent are present in the same layer.

The silver halide and the organic metal salt oxidizing agent which are separately formed can be mixed prior to use to prepare a coating solution, but it is also effective to blend both of them in a ball mill for a long period of time. Further, it is effective to use a process which comprises adding a halogen containing compound to the organic silver salt oxidizing agent prepared and forming silver halide using silver of the organic silver salt oxidizing agent and halogen of the halogen containing compound.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 mg to 10 g/m$^2$ calculated as an amount of silver.

The light-sensitive silver halide and the organic silver salt oxidizing agent used in the present invention are prepared in the binder as described below. Further, the magenta color image forming polymer coupler latex is dispersed in the binder described below.

The binder which can be used in the present invention can be employed individually or in a combination of two or more. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

The hydrophilic binder preferably includes gelatin and a gelatin derivative.

The reducing agent which can be used in the present invention is oxidized by the organic silver salt oxidizing agent to form an oxidized product capable of reacting with the magenta color image forming polymer coupler latex to form a magenta color image. An example of an effectively used reducing agent having such an ability is a color developing agent capable of forming an image upon oxidative coupling. Examples of the reducing agents used in the heat-developable color photographic material according to the present invention include a p-phenylenediamine type color developing agent including N,N-diethyl-3-methyl-p-phenylenediamine which is a typical example as described in U.S. Pat. No. 3,531,286. Further, an example of an effective reducing agent is an aminophenol as described in U.S. Pat. No. 3,761,270. Of the aminophenol type reducing agents, 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc., are particularly useful. Further, a 2,6-dichloro-4-substituted sulfonamidophenol, and a 2,6-dibromo-4-substituted sulfonamidophenol, etc., as described in *Research Disclosure,* Vol. 151, No. 15108 and U.S. Pat. No. 4,021,240 are also useful. In addition to the phenol type reducing agents described above, a naphthol type reducing agent, for example, a 4-aminonaphthol derivative and a 4-substituted sulfonamidonaphthol derivative is useful. Moreover, a generally applicable color developing agent, an aminohydroxy pyrazole derivative as described in U.S. Pat. No. 2,895,825, an aminopyrazoline derivative as described in U.S. Pat. No. 2,892,714, a hydrazone derivative as described in *Research Disclosure,* pages 227 to 230 and 236 to 240, Nos. RD-19412 and RD-19415 (June, 1980) may also be used. These reducing agents can be used individually or in a combination of two or more thereof.

The reducing agent preferably includes an aromatic primary amine compound or a hydrazone compound.

In addition to the above-described reducing agents, a reducing agent described below may be used as an auxiliary developing agent. Examples of useful auxiliary developing agents include hydroquinone, an alkyl-substituted hydroquinone such as tertiary butylhydroquinone or 2,5-dimethylhydroquinone, etc., a catechol, a pyrogallol, a halogen-substituted hydroquinone such as chlorohydroquinone or dichlorohydroquinone, etc., an alkoxy-substituted hydroquinone such as methoxyhydroquinone, etc., and a polyhydroxybenzene derivative such as methyl hydroxynaphthalene, etc. Further, methyl gallate, ascorbic acid, an ascorbic acid derivative, a hydroxylamine such as N,N'-di(2-ethoxyethyl)-hydroxylamine, etc., a pyrazolidone such as 1-phenyl-3-pyrazolidone or 4-methyl-4-hydroxymethyl-1-phenyl-3-pyrazolidone, etc., a reductone and a hydroxy tetronic acid are also useful.

The reducing agent can be used in a certain range of concentration. In general, a suitable concentration range of the reducing agent is from about 0.1 mol to about 4 mols of the reducing agent per mol of the oxidizing agent. A suitable concentration of the reducing agent used in the present invention is generally from about 0.1 mol to about 20 mols of the reducing agent per mol of the oxidizing agent.

In the heat-developable color photographic material of the present invention, various kinds of bases and base releasing agents can be employed. By the use of the base or base releasing agent, a desirable color image can be obtained at a lower temperature.

Examples of preferred bases are amines which include a trialkylamine, a hydroxyalkylamine, an aliphatic polyamine, an N-alkyl-substituted aromatic amine, an N-hydroxyalkyl-substituted aromatic amine and a bis[p-(dialkylamino)phenyl]methane. Further, betaine tetramethylammonium iodide and diaminobutane dihydrochloride as described in U.S. Pat. No. 2,410,644, and urea and an organic compound including an amino acid such as 6-aminocaproic acid as described in U.S. Pat. No. 3,506,444 are useful. The base releasing agent is a compound or a mixture which releases a basic component by heating, and the basic component is capable of activating the photographic material. Examples of typical base releasing agents are described in British Pat. No. 998,949. Preferred base releasing agents include a salt of a carboxylic acid and an organic base, and examples of suitable carboxylic acids include trichloroacetic acid and trifluoroacetic acid, etc., and examples of suitable bases include guanidine, piperidine, morpholine, p-toluidine and 2-picoline, etc. Guanidine trichloroacetate as described in U.S. Pat. No. 3,220,846 is particularly preferred. Further, an aldonic amide as described in Japanese Patent Application (OPI) No. 22625/75 are preferably used because it decomposes at a high temperature to form a base.

Further, many compounds which activate development and simultaneously stabilize the image are known can can be effectively used. Of these compounds, an isothiuronium including 2-hydroxyethyl-isothiuronium.trichloroacetate as described in U.S. Pat. No. 3,301,678, a bisisothiuronium including 1,8-(3,6-dioxaoctane)bis(isothiuronium.trifluoroacetate), etc., as described in U.S. Pat. No. 3,669,670, a thiol compound as described in West German Patent Application (OLS) No. 2,162,714, a thiazolium compound such as 2-amino-2-thiazolium.trichloroacetate and 2-amino-5-bromoethyl-2-thiazolium.trichloroacetate, etc., as described in U.S. Pat. No. 4,012,260, a compound having α-sulfonylacetate as an acid part such as bis(2-amino-2-thiazolium)methylene bis(sulfonylacetate), 2-amino-2-thiazolium phenylsulfonylacetate, etc., as described in U.S. Pat. No. 4,060,420, and a compound having 2-carboxyamide as an acid part as described in U.S. Pat. No. 4,088,496, and the like are preferably used.

These compounds or mixtures thereof can be used in an amount of a wide range. It is preferable to use them in a range of 1/100 to 10 times and, preferably, 1/20 to 2 times by molar ratio based on silver.

In the heat-developable color photographic materials of the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols described in U.S. Pat. No. 3,347,675, for example, polyethylene glycol having an average molecular weight of 1,500 to 20,000, derivatives such as oleic acid ester of polyethylene oxide, etc., beeswax, monostearin, compounds having a high dielectric constant which have $—SO_2—$ or —CO— such as acetamide, succinimide, ethylcarbamate, urea, methylsulfonamide or ethylene carbonate, polar substances described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate described in *Research Disclosure,* pp. 26 to 28 (Dec., 1976), etc.

In order to improve sharpness by means of incorporating substances or dyes for preventing irradiation or halation in the photographic materials, it is possible to add filter dyes or light absorbent materials, etc., described in Japanese Patent Publication No. 3692/73 and U.S. Pat. Nos. 3,253,921, 2,527,583 and 2,956,879, etc. It is preferred that these dyes have a thermal bleaching property. For example, dyes described in U.S. Pat. Nos. 3,769,019, 3,745,009 and 3,615,432 are preferred.

The photographic materials according to the present invention may contain, if necessary, various additives known for the heat-developable photographic materials and may have a layer other than the light-sensitive layer, for example, an antistatic layer, an electrically conductive layer, a protective layer, an intermediate layer, an antihalation layer and a strippable layer, etc. Examples of additives include those described in *Research Disclosure,* Vol. 170, No. 17029 (June, 1978), for example, plasticizers, dyes for improving sharpness, antihalation dyes, sensitizing dyes, matting agents, surface active agents, fluorescent whitening agents and fading preventing agents, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 2,681,294 and drying, likewise the case of the heat-developable photographic layer of the present invention, by which the photographic material is obtained.

If necessary, two or more layers may be applied at the same time by the method described in U.S. Pat. No. 2,761,791 and British Pat. No. 837,095.

For the heat-developable photographic materials of the present invention, various means for exposing to light can be used. Latent images are obtained by imagewise exposure by radiant rays including visible rays. Generally, light sources used for conventional color prints can be used, examples of which include tungsten lamps, mercury lamps, halogen lamps such as an iodine lamp, a xenon lamp, laser light sources, CRT light sources, fluorescent tubes and light-emitting diodes, etc.

As the original, not only line drawings but also photographs having gradation may be used. Further, it is possible to take a photograph of a portrait or landscape by means of a camera. Printing from the original may be carried out by contact printing by putting the original so as to closely contact therewith or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat-developable photographic material by contacting therewith or by means of a lens.

Recently, LED (light-emitting diode) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The photographic material to be sensitized by these lights is produced so as to form a yellow dye, a magenta dye and a cyan dye, respectively.

In addition to the above-described methods of contacting or projecting the original, there is a method of exposure wherein the original illuminated by a light source is stored in a memory of a leading computer by means of a light-receiving element such as a phototube or a charge coupling device (CCD). The resulting information is, if necessary, subjected to processing, the so-called image treatment, and resulting image information is reproduced on CRT which can be utilized as an imagelike light source or lights are emitted by three kinds of LED according to the processed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful. As the heating means, a simple heat plate, iron, heat roller or analogues thereof may be used.

In the present invention, a specific method for forming a color image by heat development comprises diffusion transfer of a diffusible dye. For this purpose, the heat-developable color photographic material is composed of a support having thereon a light-sensitive layer (I) containing at least silver halide, an organic silver salt oxidizing agent, a reducing agent for the silver halide and/or the organic silver salt oxidizing agent, a magenta color image forming polymer coupler latex and a hydrophilic binder, and an image receiving layer (II) capable of receiving the diffusible dye formed in the light-sensitive layer (I).

The above-described light-sensitive layer (I) and the image receiving layer (II) may be formed on the same support, or they may be formed on different supports, respectively. The image receiving layer (II) can be stripped off the light-sensitive layer (I). For example, after the heat-developable color photographic material is exposed imagewise to light, it is developed by heating uniformly and thereafter the image receiving layer (II) is peeled apart.

In accordance with another process, after the heat-developable color photographic material is exposed imagewise to light and developed by heating uniformly, the dye can be transferred on the image receiving layer (II) by superposing the image receiving layer on the light-sensitive layer (I) and heating to a temperature lower than the developing temperature. The temperature lower than the developing temperature in such a case includes room temperature and preferably a temperature from room temperature to a temperature not less than about 40° C. lower than the heat developing temperature. For example, a heat developing temperature and a transferring temperature are 120° C. and 80° C., respectively. Further, there is a method wherein only the light-sensitive layer (I) is exposed imagewise to light and then developed by heating uniformly by superposing the image receiving layer (II) on the light-sensitive layer (I).

The image receiving layer (II) can contain a dye mordant. In the present invention, various mordants can be used, and a useful mordant can be selected according to properties of the dye, conditions for transfer, and other components contained in the photographic material, etc. The mordants which can be used in the present invention include high molecular weight polymer mordants.

Polymer mordants to be used in the present invention are polymers containing secondary and tertiary amino groups, polymers containing nitrogen-containing hetero ring moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78, and 1024/78, etc.

In addition, mordants disclosed in U.S. Pat. Nos. 2,675,316 and 2,882,156 can be used.

Of these mordants, those which migrate with difficulty from a mordanting layer to other layers are preferable; for example, mordants capable of cross-linking with a matrix such as gelatin, water-insoluble mordants, and aqueous sol (or latex dispersion) type mordants are preferably used.

Particularly preferable polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

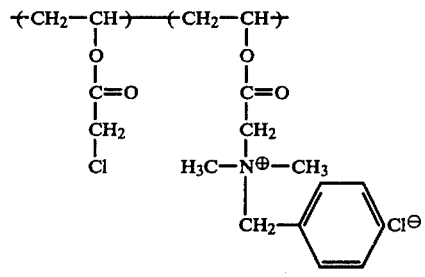

(2) Reaction products between a copolymer of a monomer represented by the following general formula with another ethylenically unsaturated monomer and a cross-linking agent (for example, bisalkanesulfonate, bisarenesulfonate, etc.):

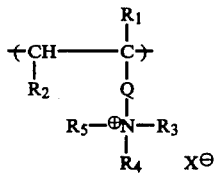

wherein $R_1$ represents H or an alkyl group, $R_2$ represents H, an alkyl group or an aryl group, Q represents a divalent group, $R_3$, $R_4$ and $R_5$ each represents an alkyl group, an aryl group or at least two of $R_3$ to $R_5$ are bonded together to form a hetero ring, and X represents an anion. The above-described alkyl groups and aryl groups may be substituted.

(3) Polymers represented by the following general formula

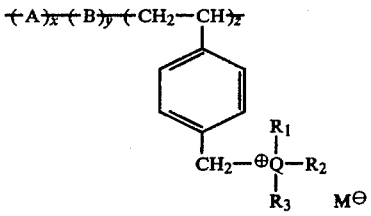

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1$, $R_2$ and $R_3$ each represents an alkyl group or a cyclic hydrocarbon group or at least two or $R_1$ to $R_3$ are bonded together to form a ring (these groups and rings may be substituted), and M represents an anion.

(4) Copolymers composed of (a), (b) and (c), wherein (a) is

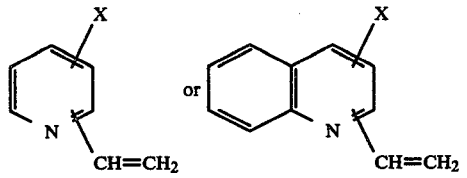

wherein X represents hydrogen, an alkyl group or a halogen atom (the alkyl group may be substituted);

(b) is an acrylic ester; and (c) is acrylonitrile.

(5) Water-insoluble polymers wherein at least ⅓ of the repeating units are those represented by the following general formula

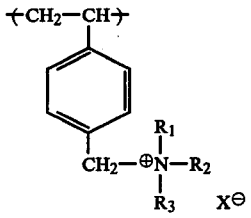

wherein $R_1$, $R_2$ and $R_3$ each represents an alkyl group, with the total number of carbon atoms being 12 or more (the alkyl group may be substituted), and X represents an anion.

Various known gelatins can be employed in the mordant layer. For example, gelatin which is produced in a different manner such as line-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from about 20/80 to 80/20 (by weight) and the amount of the mordant coated is from 0.5 to 8 g/m$^2$.

The image receiving layer (II) can have a white-reflective layer. For example, a layer of titanium dioxide dispersed in gelatin can be provided on the mordant layer on a transparent support. The layer of titanium dioxide forms a white opaque layer, by which reflection color images of the transferred color images which are observed through the transparent support are obtained.

Typical image receiving materials for diffusion transfer are obtained by mixing the polymer containing ammonium salt groups with gelatin and applying the mixture to a transparent support.

The transfer of dyes from the light-sensitive layer to the image receiving layer can be carried out using a transfer solvent. Examples of useful transfer solvents include water and an alkaline aqueous solution containing sodium hydroxide, potassium hydroxide, an inorganic alkali metal salt, etc. Further, a solvent having a low boiling point such as methanol, N,N-dimethylformamide, acetone, diisobutyl ketone, etc., and a mixture of such a solvent having a low boiling point with water or an alkaline aqueous solution can be used. The transfer solvent can be employed by wetting the image receiving layer with the transfer solvent or by incorporating it in the form of water of crystallization or microcapsules into the photographic material.

The present invention will be explained in greater detail with reference to the following examples, but the present invention should not be construed as being limited thereto.

EXAMPLE 1

6.5 g of benzotriazole and 10 g of gelatin were dissolved in 1,000 ml of water and the solution was stirred while it was maintained at 50° C. A solution containing 8.5 g of silver nitrate dissolved in 100 ml of water was added to the above-described solution for a period of 2 minutes. Then, a solution containing 1.2 g of potassium bromide dissolved in 50 ml of water was added for a period of 2 minutes. By controlling the pH of the emulsion thus-prepared to precipitate the excess salts were removed. The pH of the emulsion was then adjusted to 6.0 and 200 g of the emulsion was obtained.

In the following, a method of preparing a light-sensitive coating is described.

(a) the silver benzotriazole emulsion containing a light-sensitive silver bromide: 10 g (b) the copolymer coupler latex of Synthesis Example 4: 4 g (c) a solution containing 220 mg of guanidine trichloroacetate dissolved in 2 ml of water (d) a solution containing 200 mg of 2,6-dichloro-4-aminophenol dissolved in 2 ml of methanol The above-described components (a), (b), (c) and (d) were mixed and dissolved by heating. The solution was coated on a polyethylene terephthalate film having a thickness of 180μ at a wet thickness of 60 μm and dried. The sample thus-prepared was exposed imagewise at 2,000 lux for 4 seconds using a tungsten lamp and then uniformly heated on a heat block which had been heated at 140° C. for 30 seconds. A clear magenta color image was obtained.

EXAMPLE 2

Transfer of the Dye Formed

In the following, a method of preparing an image receiving material having an image receiving layer is described.

10 g of copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime-processed gelatin. The mixture was uniformly coated on a polyethylene terephthalate film at a wet thickness of 20 μm and dried to prepare an image receiving material.

The image receiving material was soaked in water and superposed on the heated photographic material described above and brought into contact with each of the surface layers. After 3 minutes, the image receiving material was peeled apart from the photographic material to obtain a negative magenta color image on the image receiving material. The optical density of the negative image was measured using a Macbeth transmission densitometer (TD-504). The maximum density and the minimum density to green light were 1.80 and 0.12, respectively. Further, the gradation of the sensitometric curve had a density difference of 1.20 to an exposure difference of 10 times in the straight line part.

EXAMPLE 3

The same procedure and process as described in Example 1 were repeated except using 4 g of the copolymer coupler latex of Synthesis Example 5 in place of the copolymer coupler latex of Synthesis Example 4, and thus a magenta color image and a silver image were obtained. This sample was subjected to the same process as described in Example 2 to obtain a transferred image. The maximum density and the minimum density of the transferred image were 1.90 and 0.15, respectively.

EXAMPLE 4

The same procedure and process as described in Example 3 were repeated except using 4 g of the copolymer coupler latex of Synthesis Example 6 in place of the copolymer coupler latex of Synthesis Example 5. The maximum density and the minimum density of the transferred image thus-obtained were 1.30 and 0.08, respectively.

While the invention has been described in detail and with reference to specific embodiments thereof, it will be apparent to one skilled in the art that various changes and modifications can be made therein without departing from the spirit and scope thereof.

What is claimed is:

1. A heat-developable color photographic material comprising a support having thereon at least a light-sensitive silver halide, an organic silver salt oxidizing agent, a hydrophilic binder, a reducing agent for the silver halide and/or the organic silver salt oxidizing agent and a magenta color image forming polymer coupler latex which is capable of forming a diffusible dye upon coupling with an oxidized product of the reducing agent and which is a homopolymer or copolymer having a repeating unit derived from a monomer coupler represented by the following general formula (I):

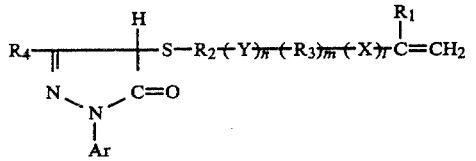

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1.

2. A heat-developable color photographic material as claimed in claim 1, wherein the alkylene group represented by $R_2$ is an alkylene group having from 1 to 10 carbon atoms.

3. A heat-developable color photographic material as claimed in claim 1, wherein the alkylene group represented by $R_3$ is an alkylene group having from 1 to 10 carbon atoms.

4. A heat-developable color photographic material as claimed in claim 1, wherein the substituent for the substituted alkylene group, the substituted arylene group or the substituted aralkylene group represented by $R_2$ or $R_3$ is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group or a sulfonyl group.

5. A heat-developable color photographic material as claimed in claim 1, wherein the substituent for the substituted phenyl group represented by Ar is an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an arylsulfonamido group, a sulfamoyl group, an alkylsulfamoyl group, a dialkylsulfamoyl group, an alkylthio group, an arylthio group, a cyano group, a nitro group, or a halogen atom.

6. A heat-developable color photographic material as claimed in claim 1, wherein the substituent for the substituted phenyl group represented by Ar is a halogen atom, an alkyl group, an alkoxy group, an alkoxycarbonyl group, or a cyano group.

7. A heat-developable color photographic material as claimed in claim 1, wherein the substituent for the substituted anilino group, the substituted acylamino group or the substituted ureido group represented by $R_4$ is a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, a sulfo group, a hydroxy group or a trichloromethyl group.

8. A heat-developable color photographic material as claimed in claim 7, wherein the alkyl moiety and the aryl moiety included in the substituent is an alkyl group having from 1 to 36 carbon atoms and an aryl group having from 6 to 38 carbon atoms, respectively.

9. A heat-developable color photographic material as claimed in claim 1, wherein the copolymer contains a repeating unit derived from a non-color forming ethylenic monomer which does not couple with the oxidation product of an aromatic primary amine developing agent.

10. A heat-developable color photographic material as claimed in claim 9, wherein the non-color forming ethylenic monomer is an acrylic acid ester, an acrylic acid amide, a vinyl ester, an acrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinyl pyridine, or 2- or 4-vinyl pyridine.

11. A heat-developable color photographic material as claimed in claim 9, wherein the non-color forming ethylenic monomer is an acrylic acid ester, a methacrylic acid ester or a maleic acid ester.

12. A heat-developable color photographic material as claimed in claim 1, wherein the amount of the color forming portion in the polymer coupler latex is from 5% to 80% by weight.

13. A heat-developable color photographic material as claimed in claim 1, wherein the amount of the color forming portion in the polymer coupler latex is from 20% to 70% by weight.

14. A heat-developable color photographic material as claimed in claim 12, wherein the gram number of the polymer coupler latex containing 1 mol of coupler monomer is from 250 to 3,000.

15. A heat-developable color photographic material as claimed in claim 1, wherein the magenta color image forming polymer coupler latex is a latex prepared by emulsion polymerization of a monomer comprising a monomer coupler represented by the general formula (I).

16. A heat-developable color photographic material as claimed in claim 1, wherein the magenta color image forming polymer coupler latex is a latex prepared by dissolving a hydrophobic polymer coupler obtained by polymerization of a monomer comprising a monomer coupler represented by the general formula (I) in an organic solvent and then dispersing the solution in a latex form in an aqueous gelatin solution.

17. A heat-developable color photographic material as claimed in claim 1, wherein the magenta color image forming polymer coupler latex is present in an amount of from 0.01 mol to 4 mols per mol of silver calculated as a mol number of the coupler component.

18. A heat-developable color photographic material as claimed in claim 1, wherein the light-sensitive silver halide is selected from the group consisting of silver chloride, silver chlorobromide, silver chloroiodide, silver bromide, silver iodobromide, silver chloroiodobromide and silver iodide.

19. A heat-developable color photographic material as claimed in claim 1, wherein the organic silver salt oxidizing agent is present in a range of from 0.01 mol to 100 mols per mol of the light-sensitive silver halide.

20. A heat-developable color photographic material as claimed in claim 1, wherein the particle size of the silver halide is from 0.001 μm to 10 μm.

21. A heat-developable color photographic material as claimed in claim 1, wherein the organic silver salt oxidizing agent is a silver salt which forms silver by reacting with the reducing agent, when it is heated to a temperature of above 80° C. in the presence of exposed silver halide.

22. A heat-developable color photographic material as claimed in claim 1, wherein the organic silver salt oxidizing agent is a silver salt of an organic compound having a carboxy group, a silver salt of a compound containing a mercapto group or a thione group or a silver salt of a compound containing an imino group.

23. A heat-developable color photographic material as claimed in claim 1, wherein the organic silver salt oxidizing agent is a silver salt of a carboxylic acid derivative or an N-containing heterocyclic compound.

24. A heat-developable color photographic material as claimed in claim 1, wherein the light-sensitive silver halide and the organic silver salt oxidizing agent are present in the same layer.

25. A heat-developable color photographic material as claimed in claim 1, wherein the hydrophilic binder is gelatin or a gelatin derivative.

26. A heat-developable color photographic material as claimed in claim 1, wherein the reducing agent is a compound which is oxidized by the organic silver salt oxidizing agent to form an oxidized product capable of reacting with the magenta color image forming polymer coupler latex and forming a dye.

27. A heat-developable color photographic material as claimed in claim 26, wherein the reducing agent is a color developing agent which is capable of forming an image upon oxidative coupling.

28. A heat-developable color photographic material as claimed in claim 27, wherein the reducing agent is a p-phenylenediamine type color developing agent, an aminophenol compound, an aminonaphthol compound, an aminohydroxypyrazole compound, an aminopyrazoline compound or a hydrazone compound.

29. A heat-developable color photographic material as claimed in claim 27, wherein the reducing agent is an aromatic primary amine compound or a hydrazone compound.

30. A heat-developable color photographic material as claimed in claim 1, wherein the color photographic material further contans an auxiliary developing agent.

31. A heat-developable color photographic material as claimed in claim 1, wherein the reducing agent is present in an amount of from 0.1 mol to 20 mols per mole of the oxidizing agent.

32. A heat-developable color photographic material as claimed in claim 1, wherein the color photographic material further contains a base or a base releasing agent.

33. A heat-developable color photographic material as claimed in claim 32, wherein the base releasing agent is a salt of a carboxylic acid and an organic base.

34. A heat-developable color photographic material as claimed in claim 33, wherein the base releasing agent is guanidine trichloroacetate.

35. A heat-developable color photographic material as claimed in claim 1, wherein the color photographic material further contains a compound which activates development and simultaneously stabilizes the image.

36. A heat-developable color photographic material as claimed in claim 1, wherein the color photographic material further contains a thermal solvent.

37. A heat-developable color photographic material as claimed in claim 1, wherein the color photographic material further comprises an image receiving layer capable of receiving the diffusible dye formed in the light-sensitive layer.

38. A heat-developable color photographic material as claimed in claim 37, wherein the image receiving layer contains a dye mordant.

39. A heat-developable color photographic material as claimed in claim 37, wherein the image receiving layer contains a polymer mordant and gelatin.

40. A heat-developable color photographic material as claimed in claim 1, wherein the color photographic material further contains a transfer solvent.

41. A heat-developable color photographic material as claimed in claim 40, wherein the transfer solvent is selected from the group consisting of water and an alkaline aqueous solution.

42. A method for forming a color image, comprising the steps of:

providing a heat-developable color photographic material comprising a support having thereon at least a light-sensitive silver halide, an organic silver salt oxidizing agent, a hydrophilic binder, a reducing agent for the silver halide and/or the organic silver salt oxidizing agent and a magenta color image forming polymer coupler latex which is capable of forming a diffusible dye upon coupling with an oxidized product of the reducing agent and which is a homopolymer or copolymer having a repeating unit derived from a monomer coupler represented by the following general formula (I):

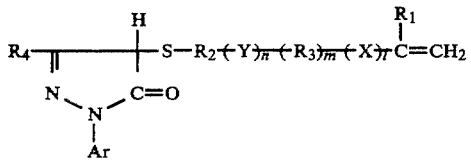

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1;

imagewise exposing the heat-developable photographic material; and developing the exposed color photographic material by uniformly heating the material to form a diffusible dye and transferring the diffusible dye into an image receiving material.

43. A method of forming a color image as claimed in claim 42, wherein the heating is carried out at a temperature ranging from 80° C. to 250° C.

44. A method of forming a color image as claimed in claim 42, wherein the transferring of the diffusible dye is carried out using a transfer solvent.

45. A method of forming a color image as claimed in claim 44, wherein the transfer solvent is selected from the group consisting of water and an alkaline aqueous solution.

46. A method of forming a color image as claimed in claim 42, wherein the image receiving material contains a mordant for the diffusible dye.

47. A method for forming a color image, comprising the steps of:

providing a heat-developable color photographic material comprising a support having thereon at least a light-sensitive silver halide, an organic silver salt oxidizing agent, a hydrophilic binder, a reducing agent for the silver halide and/or the organic silver salt oxidizing agent and a magenta color image forming polymer coupler latex which is capable of forming a diffusible dye upon coupling with an oxidized product of the reducing agent and which is a homopolymer or copolymer having a repeating unit derived from a monomer coupler represented by the following general formula (I):

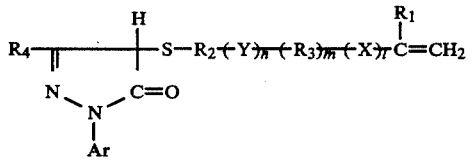

(I)

wherein $R_1$ represents hydrogen, a lower alkyl group containing from 1 to 4 carbon atoms or a chlorine atom; $R_2$ and $R_3$, which may be the same or different, each represents an unsubstituted or substituted alkylene group which may be a straight chain or a branched chain, an unsubstituted or substituted arylene group or an unsubstituted or substituted aralkylene group; X represents —CONH— or —COO—; Y represents —O—, —S—, —SO—, —$SO_2$—, —CONH— or —COO—; Ar represents an unsubstituted or substituted phenyl group; $R_4$ represents an unsubstituted or substituted anilino group, an unsubstituted or substituted acylamino group or an unsubstituted or substituted ureido group; l represents 0 or 1; m represents 0 or 1; and n represents 0 or 1;

imagewise exposing the heat-developable color photographic material; and developing the exposed color photographic material by uniformly heating the material to form a diffusible dye, contacting an image receiving material with the layer containing the diffusible dye of the color photographic material, transferring the diffusible dye onto the image receiving material and peeling apart the image receiving layer from the color photographic material.

* * * * *